US007770572B2

(12) United States Patent
Lian

(10) Patent No.: US 7,770,572 B2
(45) Date of Patent: Aug. 10, 2010

(54) PAINT BALL GUN

(75) Inventor: Sheng-Jen Lian, Taichung County (TW)

(73) Assignee: Yao-Gwo Gan, Taichung (TW)

( * ) Notice: Subject to any disclaimer, the term of this patent is extended or adjusted under 35 U.S.C. 154(b) by 0 days.

(21) Appl. No.: 12/153,290

(22) Filed: May 16, 2008

(65) Prior Publication Data

US 2009/0283086 A1 Nov. 19, 2009

(51) Int. Cl.
*F42B 11/00* (2006.01)

(52) U.S. Cl. ..... 124/74; 124/73; 124/75; 124/77

(58) Field of Classification Search ..... 124/73–75, 124/77

See application file for complete search history.

(56) References Cited

U.S. PATENT DOCUMENTS 7,509,953 B2 * 3/2009 Wood ..... 124/73
7,527,049 B2 * 5/2009 Sheng ..... 124/73
2003/0005918 A1 * 1/2003 Jones ..... 124/70
2006/0169265 A1 * 8/2006 Lai ..... 124/71
2007/0151549 A1 * 7/2007 Wood ..... 124/73
2007/0209650 A1 * 9/2007 Jones ..... 124/73
2008/0011283 A1 * 1/2008 Lai ..... 124/73
2008/0047538 A1 * 2/2008 Gan ..... 124/74

* cited by examiner

*Primary Examiner*—Troy Chambers
*Assistant Examiner*—Gabriel J Klein
(74) *Attorney, Agent, or Firm*—Banger Shia

(57) ABSTRACT

A paint ball gun includes a frame defining a frame bore therein and a valve located below the frame. The valve communicates with a first path which communicates with the barrel. A bolt and a strike rod are received in the frame bore. The valve guides pressurized air to the rear end of the strike rod to move the strike rod to push the bolt which has a central passage. When shooting, the central passage opened and the pressurized air flows through the central passage to eject paint balls.

6 Claims, 6 Drawing Sheets

PAINT BALL GUN

BACKGROUND OF THE INVENTION (1) Field of the Invention

The present invention relates to a paint ball gun with simple structure.

(2) Description of the Prior Art

A conventional paint ball gun generally includes many parts which require precise machining and many holes and paths are needed in the main part of the paint ball gun. The multiple machining processes increase the fabrication cost. The strike rod in the barrel of the conventional paint ball gun cannot be made to have sufficient end surface to which the pressurized air applies a force so as to send the paint balls to far distance, because the complicated structure restricts the size of the strike rod.

The present invention intends to provide a paint ball gun which has a simple structure and the strike rod is supplied by sufficient force so that the efficiency for shooting the paint balls is increased while the fabrication cost is kept at low level.

SUMMARY OF THE INVENTION

The present invention relates to a paint ball gun which comprises a frame defining a frame bore therein and a valve located below the frame. The valve communicates with a first path which communicates with the frame bore. A bolt and a strike rod are received in the frame bore, wherein the bolt has a central passage defined therethrough which communicates with the first path. The bolt is movable between a first position and a second position. The strike rod has a first end in contact with one end of the bolt to seal the central passage. The first path communicates a space located at a second end of the strike rod so as to move the strike rod between a first position and a second position. A travel distance of the strike rod between the first and second positions of the strike rod is shorter than a travel distance of the bolt between the first and second positions of the bolt. The bolt is separated from the strike rod when the strike rod moves to its second position so as to open the central passage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
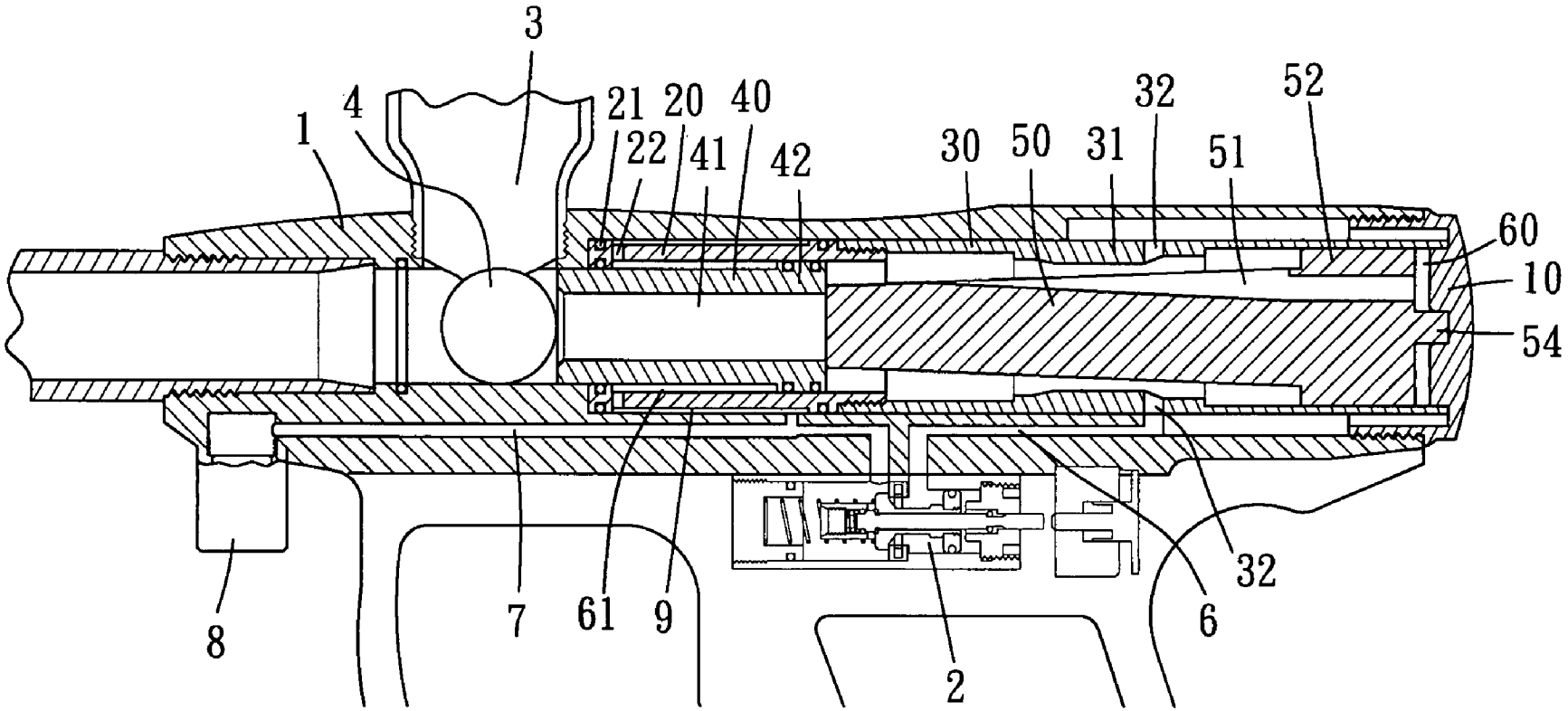
FIG. 1 is a cross sectional view to show the paint ball gun of the present invention.
Figure 2:
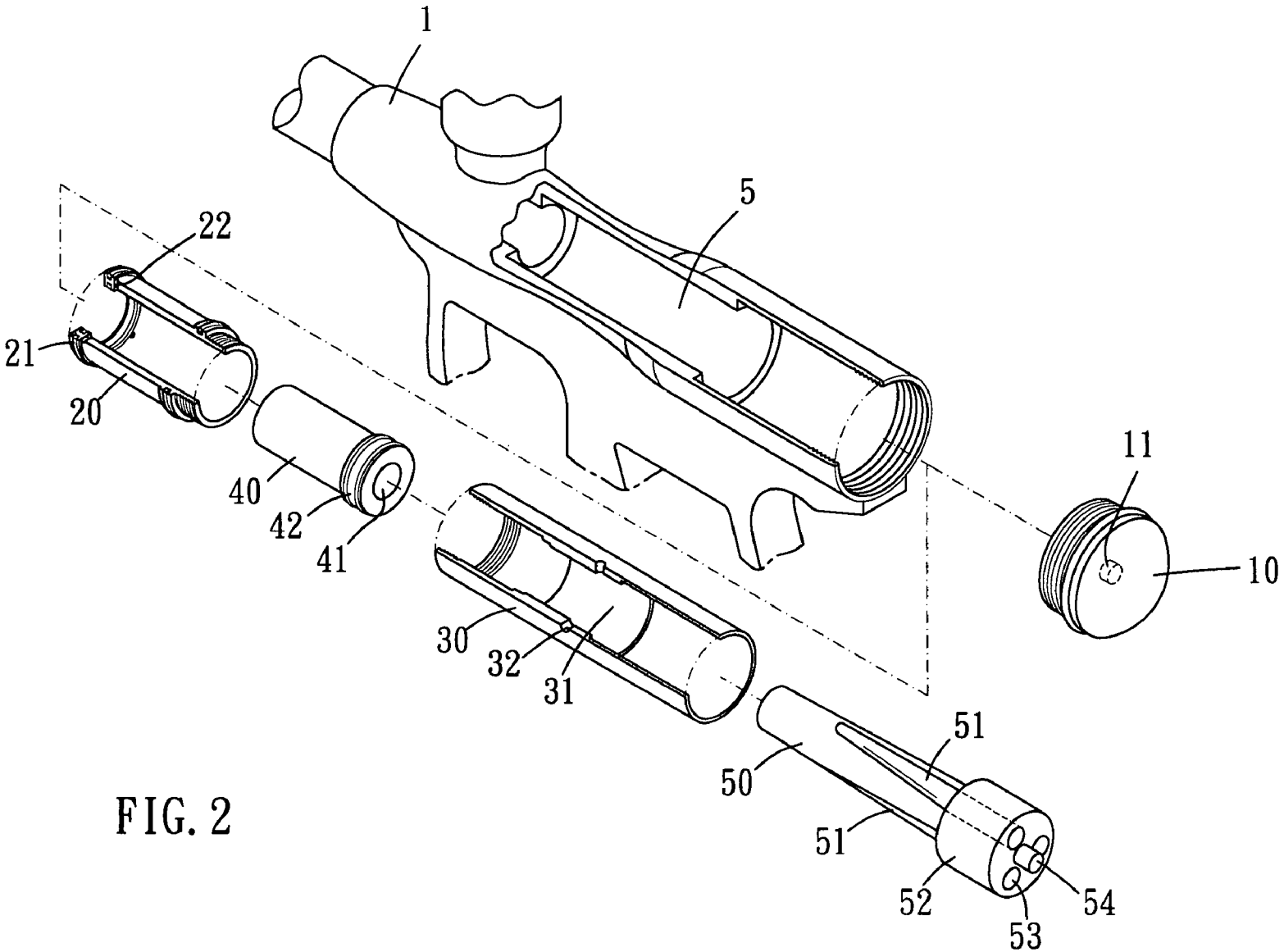
FIG. 2 is an exploded view to show the paint ball gun of the present invention.

Referring to FIGS. 1 and 2, the paint ball gun of the present invention comprises a frame 1 defining a frame bore 5 therein and a valve 2 located below the frame 1, a handle is connected to the frame 1 and a trigger (not shown) is connected to the handle so as to activate the valve 2. The valve 2 communicates with a first path 6 in the frame bore 5 and the first path 6 communicates with the frame bore 5. A first tube 20 and a second tube 30 are received in the frame bore 5. The first tube 20 is located close to a drop hole 3 defined in the frame 1 and a bolt 40 is received in the first tube 20. The second tube 30 is threadedly connected to an end of the first tube 20 and a strike rod 50 is received in the second tube 30. A hopper is connected to the drop hole 31 so that paint balls 4 are supplied into the frame bore 4-5 via the drop hole 3. The frame 1 further includes a second path 7 which is in communication between the valve 2 and an air source 8.

The bolt 40 has a central passage 41 defined therethrough which communicates with the first path 6, and the bolt 40 is movable between a first position and a second position. The strike rod 50 is a cylindrical rod and has a first end in contact with one end of the bolt 40 so as to seal the central passage 41. An axial guide path 51 is defined in an outside of the strike rod 50 and communicates with a second end of the strike rod 50. A first protrusion 52 is connected to the second end of the strike rod 50. The second tube 30 has a first stop 31 at an inner periphery thereof and the first protrusion 52 can be stopped by the first stop 31.

The first stop 31 has a first hole 32 defined through a wall thereof. An end cap 10 is connected to a rear end of the frame 1 and has a recess 11 defined in an inside thereof. The second end of the strike rod 50 has a positioning portion 54 which is inserted into the recess 11. A length of the positioning portion 54 is longer than a depth of the recess 11 so that a first chamber 60 is defined between the inside of the end cap 10 and the second end of the strike rod 50. The first path 6 communicates with the first chamber 60 so as to move the strike rod 50 between a first position and a second position.

A travel distance of the strike rod 50 between the first and second positions of the strike rod 50 is shorter than a travel distance of the bolt 40 between the first and second positions of the bolt 40, so that the bolt 40 is separated from the strike rod 50 when the strike rod 50 moves to its second position so as to open the central passage 41.

The bolt 40 includes a second protrusion 42 extending radially therefrom and a second stop 21 extends inward from an inner periphery of the first tube 20. A second chamber 61 is defined between the second protrusion 42 and the second stop 21 when the bolt 40 is located at the first position. The first tube 20 has a second hole 22 defined radially through a wall thereof and the second hole 22 communicates with the second chamber 61. The second path 7 includes a third path 9 which communicates with the second hole 22.

Figure 3:
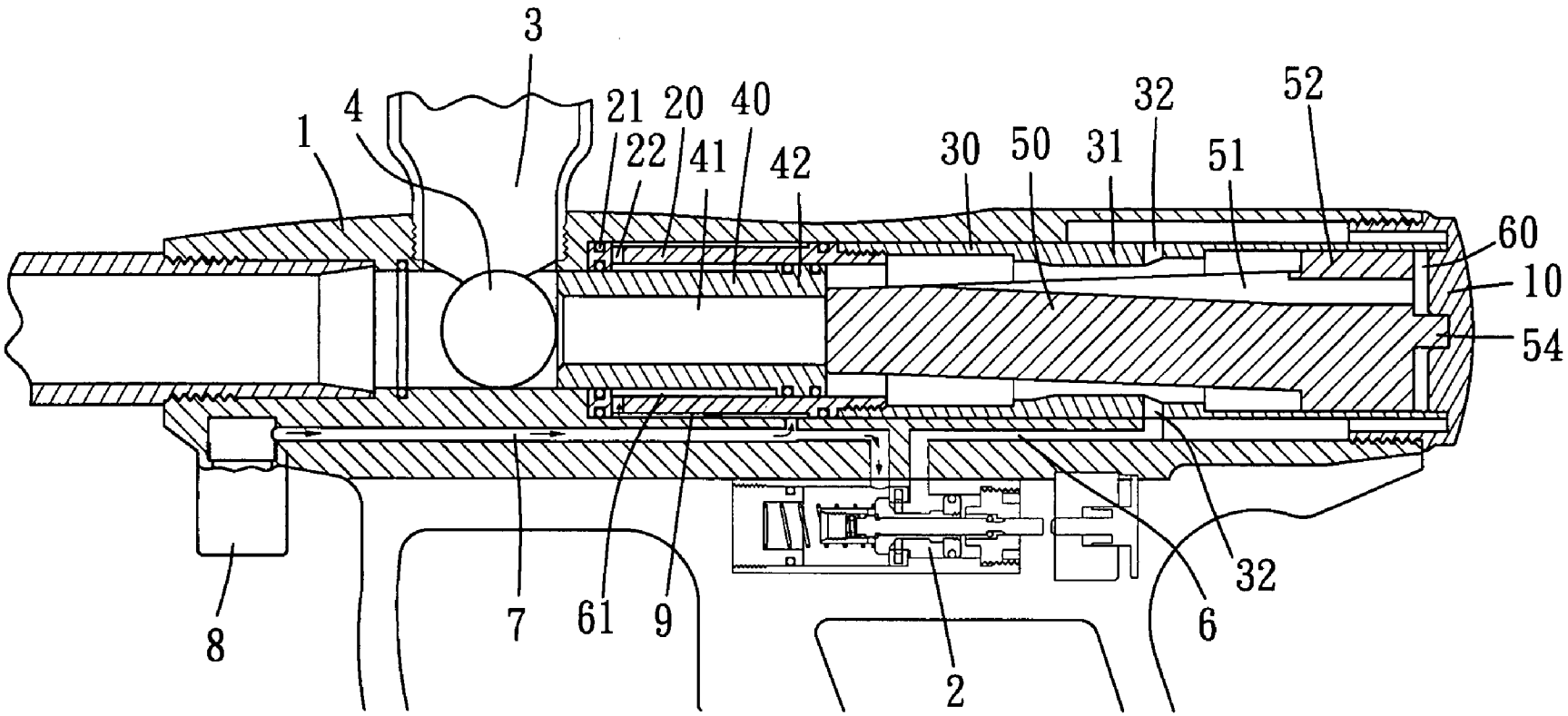
FIG. 3 is a cross sectional view to show the paint ball gun of the present invention, wherein the trigger is not yet pulled.

As shown in FIG. 3, when the trigger is not yet pulled, the pressurized air in the air source 8 enters the valve 2 via the second path 7. The valve 2 is not activated so that the pressurized air cannot enter the second tube 30 via the first path 6. The pressurized air enters the second chamber 61 via the second hole 22 and the third path 9 so as to push the second protrusion 42 of the bolt 40. The bolt 40 is pushed to contact the first end of the strike rod 50 and the positioning portion 54 of the strike rod 50 is inserted into the recess 11.

Figure 4:
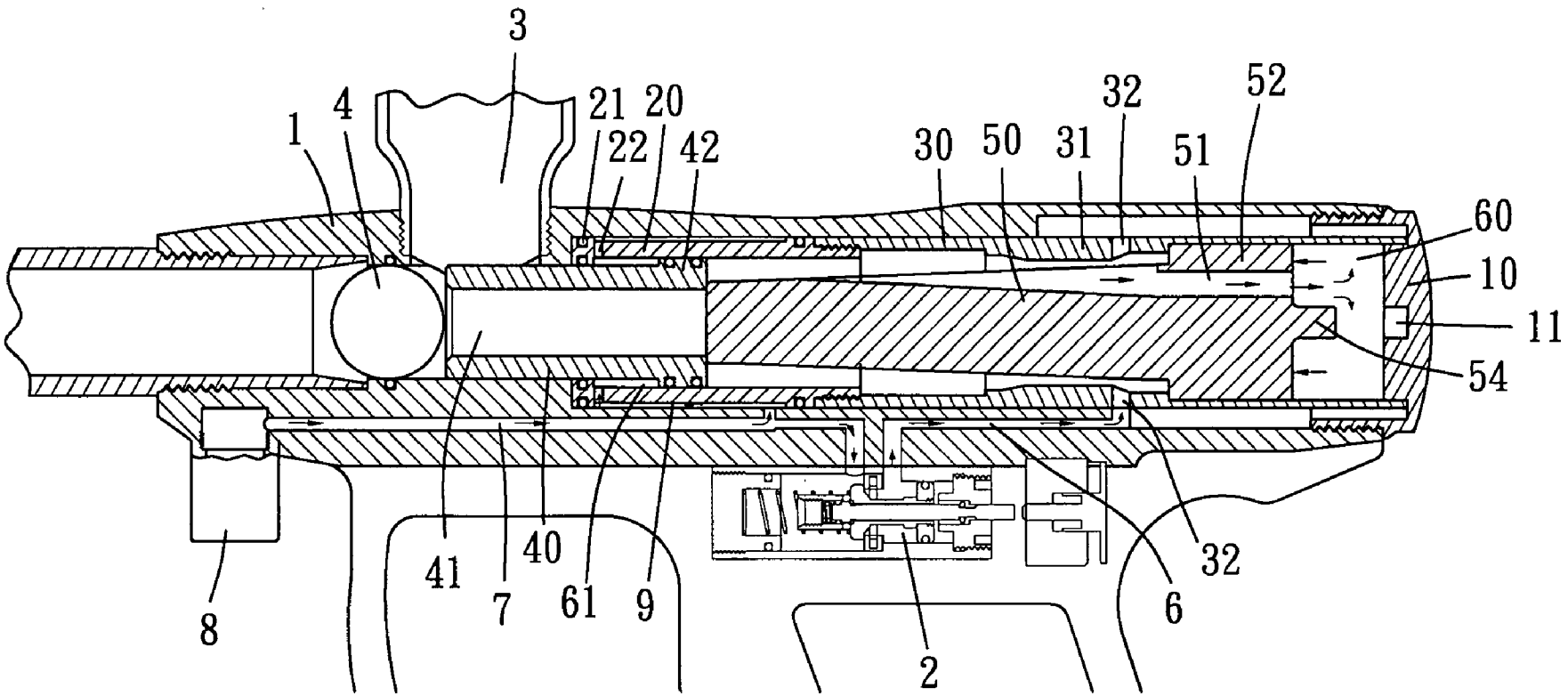
FIG. 4 is a cross sectional view to show the first travel distance of movement of the paint ball gun of the present invention.

FIG. 4 shows that when the valve 2 is activated, the pressurized air enters the second tube 30 via the first path 6 and the first hole 32, the pressurized air flows to the two ends of the second tube 30 along the guide path 51. The pressurized air enters the first chamber 60 via the first hole 32 and the guide path 51 so that the strike rod 50 is pushed to the second position. The bolt 40 is then moved to the second position and indirectly moves the paint ball 4.

Figure 5:
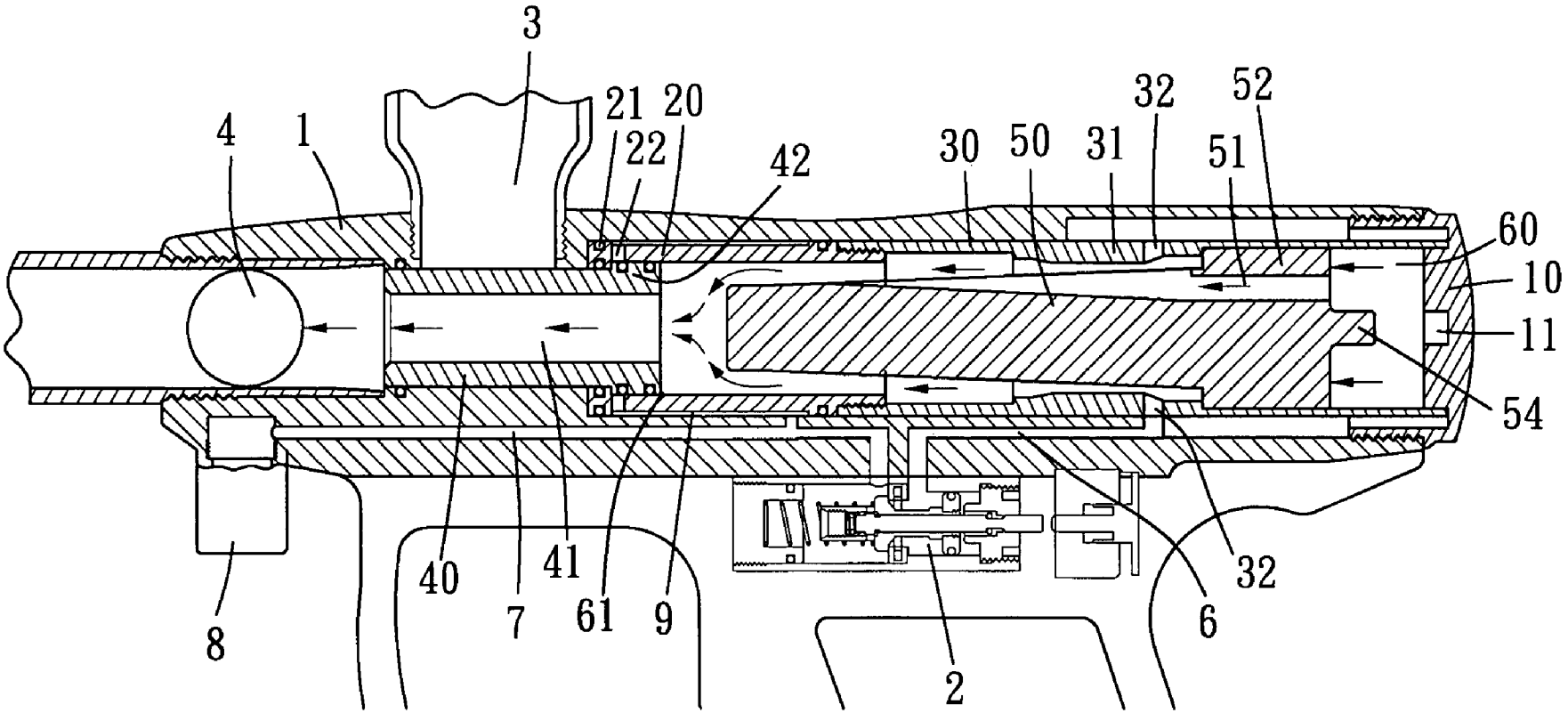
FIG. 5 is a cross sectional view to show the second travel distance of movement of the paint ball gun of the present invention.

As shown in FIG. 5, because the second travel distance is longer than the first travel distance, so that when the strike rod 50 is moved to the second position, the first protrusion 52 is stopped by the first stop 31, and the pressurized air pushes the bolt 40 again and the central passage 41 is opened. The pressurized air flows along the guide path 51 and the central passage 41 to send the paint ball 4. Besides, the pressurized air flows to the third path 9 via the second path 7, and enters the second chamber 61 via the second hole 22 to move the bolt 40 and the strike rod 50 back to their original positions and ready for the next shoot.

Figure 6:
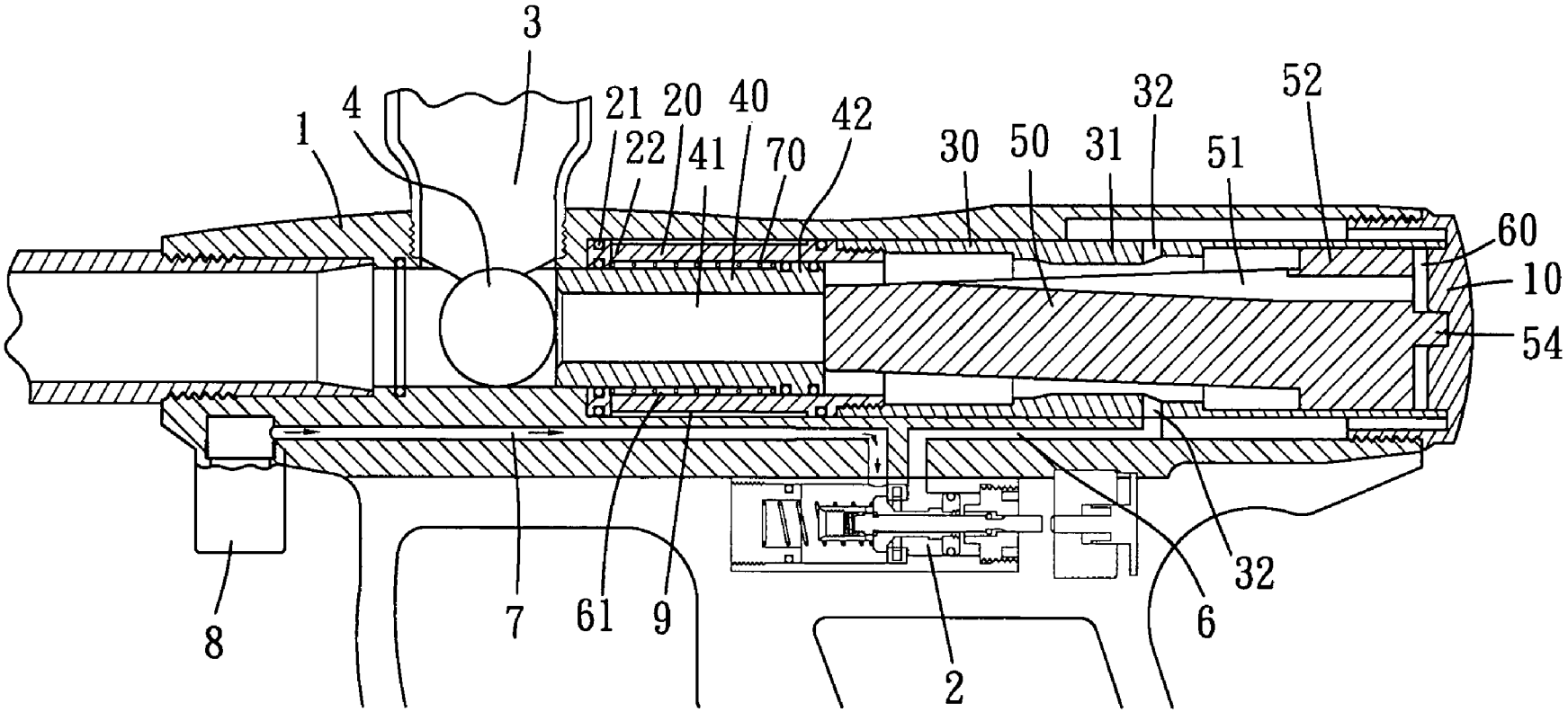
FIG. 6 shows another embodiment of the paint ball gun of the present invention.

FIG. 6 shows another embodiment, wherein a spring 70 is located in the second chamber 61 and between the frame 1 and the bolt 40, the spring 70 biases the bolt 40 to contact against the strike rod 50 to prevent the central passage 41 from being in communication with the second tube 30. The spring 70 also pushes the bolt 40 and the strike rod 50 back to their original positions and ready for the next shoot.

While we have shown and described the embodiment in accordance with the present invention, it should be clear to those skilled in the art that further embodiments may be made without departing from the scope of the present invention.

What is claimed is:

1. A paint ball gun comprising:

a frame defining a frame bore therein and a valve located below the frame and communicating with a first path which communicates with the frame bore;

a bolt received in the frame bore and having a central passage defined therethrough which communicates with the first path, the bolt movable between a first position and a second position;

a strike rod received in the frame bore having a first end in contact with one end of the bolt to seal the central passage, and the first path communicating with a space located at a second end of the strike rod so as to move the strike rod between a first position and a second position, a travel distance of the strike rod between the first and second positions of the strike rod being shorter than a travel distance of the bolt between the first and second positions of the bolt, the bolt being separated from the strike rod when the strike rod moves to its second position so as to open the central passage;

wherein a first tube and a second tube are received in the frame bore, the first tube is located close to a drop hole defined in the frame and the bolt is received in the first tube, the second tube is threadedly connected to an end of the first tube and the strike rod is received in the second tube;

wherein the strike rod is a cylindrical rod which includes an axial guide path defined in an outside thereof and the guide path communicates with a second end of the strike rod, a first protrusion is connected to the second end of the strike rod, the second tube has a first stop at an inner periphery thereof and the first protrusion is stopped by the first stop.

2. The paint ball gun as claimed in claim 1, wherein the frame includes a second path which is in communication between the valve and an air source.

3. The paint ball gun as claimed in claim 1, wherein the first stop has a first hole defined through a wall thereof, an end cap is connected to a rear end of the frame and has a recess defined in an inside thereof, the second end of the strike rod has a positioning portion which is inserted into the recess, a length of the positioning portion is shorter than a depth of the recess so that a first chamber is defined between the inside of the end cap and the second end of the strike rod.

4. The paint ball gun as claimed in claim 1, wherein the bolt includes a second protrusion extending radially therefrom and a second stop extends inward from an inner periphery of the first tube, a second chamber is defined between the second protrusion and the second stop when the bolt is located at the first position, the first tube has a second hole defined radially through a wall thereof and the second hole communicates with the second chamber.

5. The paint ball gun as claimed in claim 4, wherein the frame includes a second path which is in communication between the valve and an air source, the second path includes a third path which communicates with the second hole.

6. The paint ball gun as claimed in claim 1, wherein a spring is located between the frame and the bolt, the spring biases the bolt to contact against the strike rod.

* * * * *